United States Patent [19]

Stifano

[11] 4,109,820

[45] Aug. 29, 1978

[54] SELF-THREADING CONTAINER CLOSURE AND METHOD THEREOF

[75] Inventor: Joseph Michael Stifano, Middleton, N.Y.

[73] Assignee: International Paper Company, New York, N.Y.

[21] Appl. No.: 805,071

[22] Filed: Jun. 9, 1977

[51] Int. Cl.[2] ..... B65B 1/04; B65D 41/04; B65D 41/10

[52] U.S. Cl. ..... 220/240; 53/7; 141/3; 141/20; 220/72; 220/288; 220/289; 222/394; 229/5.5

[58] Field of Search ..... 229/4.5, 5-7, 229/5.5; 220/288, 289, DIG. 19, 72, 307, 240; 138/96 T, 89; 215/271, 318, 356; 426/394, 477; 285/40, DIG. 2; 141/3, 5, 20, 22; 222/563, 568, 394, 402.22; 53/7, 22 R

[56] References Cited

U.S. PATENT DOCUMENTS

| | | | |
|---|---|---|---|
| Re. 25,906 | 11/1965 | Livingstone | 220/307 |
| 2,117,407 | 5/1938 | Davis | 220/288 |
| 2,261,621 | 11/1941 | Harrison | 229/5.5 |
| 2,330,742 | 9/1943 | Poupitch | 220/240 |
| 2,623,443 | 12/1952 | Robinson | 93/80 |
| 2,623,445 | 12/1952 | Robinson | 156/64 |
| 2,741,405 | 4/1956 | Efford et al. | 222/402.22 |
| 2,780,243 | 2/1957 | Williams et al. | 220/288 |
| 2,962,185 | 11/1960 | Starr et al. | 220/254 |
| 2,977,993 | 4/1961 | Scherer | 138/96 T |
| 3,021,974 | 2/1962 | Watts | 220/304 |
| 3,098,582 | 7/1963 | Martin | 229/5.7 |
| 3,156,372 | 11/1964 | Parker | 220/307 |
| 3,178,088 | 4/1965 | Herr | 229/4.5 |
| 3,428,239 | 2/1969 | Wannamaker et al. | 229/5.6 |
| 3,563,423 | 2/1971 | Wilson | 222/396 |
| 3,608,771 | 9/1971 | Monroe et al. | 220/266 |
| 3,664,540 | 5/1972 | Witkin | 220/288 |
| 3,799,388 | 3/1974 | Knize | 220/240 |
| 3,799,821 | 3/1974 | Jones | 229/4.5 |

FOREIGN PATENT DOCUMENTS

| | | | |
|---|---|---|---|
| 659,127 | 4/1964 | Belgium | 285/40 |
| 539,214 | 4/1957 | Canada | 285/40 |
| 428,909 | 5/1935 | United Kingdom. | |

*Primary Examiner*—William Price
*Assistant Examiner*—Allan N. Shoap
*Attorney, Agent, or Firm*—James F. Haley, Jr.

[57] ABSTRACT

A self-threading container closure for a spiral wound tube useful as a container for fluids under pressure. The closure insert includes side threads in conjunction with a spherical arch and support legs. The threads permit the insert to be screwed into the walls of the tube and allow the spiral wound media to form around the closure in a liquid and pressure tight seal. This seal is enhanced by a transfer of outward fluid pressure on the spherical arch through the support legs to the threads and container walls.

9 Claims, 6 Drawing Figures

SELF-THREADING CONTAINER CLOSURE AND METHOD THEREOF

BACKGROUND OF THE INVENTION

This invention relates to spiral wound containers for packaging fluid products, especially those which must be maintained under substantial pressure. More particularly, this invention is directed at an improved closure for such containers. This novel closure, simple to construct and insert, affords an effective liquid and pressure tight seal.

Spiral wound containers have been available for many years and a variety of methods and apparatus have been devised for making such containers, for example U.S. Pat. Nos. 2,261,621, 2,623,443, 2,623,445, 3,178,088, 3,428,239, 3,608,771, and British patent specification No. 428,909. These containers have a number of advantages, the principal one of which is their economy as compared to more standard containers.

This attribute is of special import in containers for the shipping of fluids under pressure. These fluids such as soft drink syrups, carbonated beverages or beers, chemicals, gases or other liquids commonly are shipped to the point of consumption or use in stainless steel shipping dispensers. These metal dispensers are very costly to purchase and their return rate, necessitated by their high fabrication cost, is both low and expensive to accomplish. The replacement of such metal containers with a spiral wound construction beneficially advantages both these prior limitations. The costs of fabrication are so substantially reduced that the containers are economically disposable. The disposability avoids the costs of pick-up and return.

However, prior art disposable spiral wound containers for such fluids have not been wholly successful. Rather, they have displayed an inability to retain the necessary internal pressure of the packaged fluid. This disadvantage has inhered in both the side walls used to fabricate the usually tubular containers and in the final sealing of such tubes by end closure thereof. This time dependent leakage substantially decreases shelf life and limits the use of these packages in pressurized fluid applications.

Although side wall construction has been substantially improved, such as in U.S. Pat. Nos. 3,428,239 and 3,608,771, as to be capable of better retaining these internal fluid pressures, the end closures and methods thereof still display less than optimum economy and utility. Rather, prior leak-proof closures and methods thereof, disclosed for example by U.S. Pat. Nos. 2,261,621, 3,021,974, 3,178,088, 3,428,239, 3,664,540, and British patent specification No. 428,909, are complex and substantially blunt that economy fostered by disposable spiral wound packaging.

SUMMARY OF THE INVENTION

It is accordingly an object of this invention to provide a closure and method thereof for spiral wound containers. More particularly, this closure and method are useful for the disposable packaging of fluids under pressure.

The closure of this invention is an insert which comprises a concave spherical face; an inverted annular flange depending therefrom, the outer surface of the flange being threaded with preferably a buttress-type thread; and a plurality of radial support members underlying the flange and a major portion of the face, this portion excluding only the central portion of the spherical face. Preferably these support members have horizontal feet and together with the unsupported portion of the face define a convex arch of smaller diameter than the spherical face.

To effect pressure and liquid tight closure of well-known spiral wound tubes, especially those used to package fluids under pressure, the insert of this invention is screwed into an open end of the wound tube. This end preferably is unthreaded, having parallel, smooth inner side walls. This screwing action causes the spiral wound media to form around the closure and threads thereof in a tight seal. The threads are preferably of the buttress-type to effectively preclude unscrewing of the insert.

The initial seal improves as the insert is subjected to that internal pressure of the packaged fluid. It is believed that this improvement of the insert-container seal is caused by a transfer of the outward pressure of the fluid from the concave spherical face through the support members to the annular flange and threads thereon. This redirection of the downward fluid force components to a transverse force on the threads of the insert tightens the seal between the container walls and threads. The extent of this improvement is of course dependent on the internal pressure of the fluid, the rigidity and force redirection characteristics of the insert and the inherent radial strength of the container walls.

DESCRIPTION OF THE PREFERRED EMBODIMENTS

Figure 1:
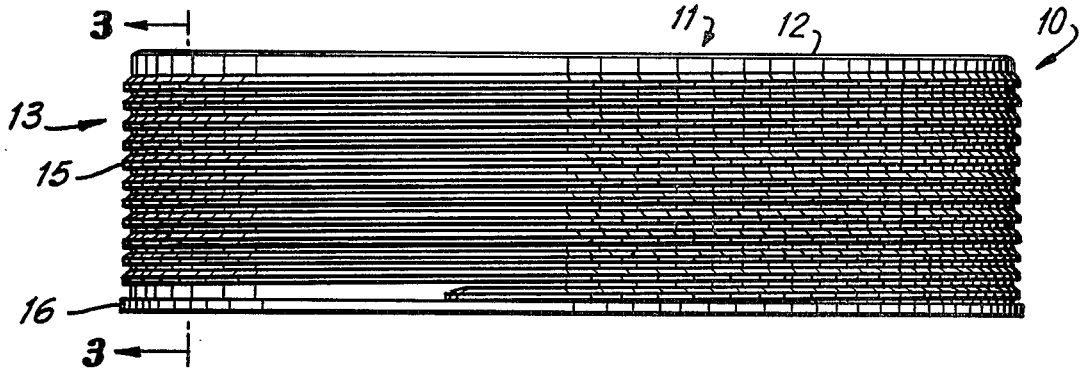
FIG. 1 is a side view of an insert of this invention.

Referring to FIG. 1 of the drawings, there is depicted a closure insert 10 of this invention. The insert may be fabricated from a large range of materials. These include paperboard, polymeric material, metal and other similar materials. Persons skilled in the art will recognize the selection of an appropriate material from this class. Factors affecting this choice include the properties of the fluid to be packaged, the expected internal pressurization, the type of container lining if any to be employed, and the container stresses likely under normal handling conditions. Most preferably, this closure insert is fabricated from polyethylene or polypropylene which has been specially treated to display desired properties of, for example, chemical resistance and impermeability.

Figure 2:
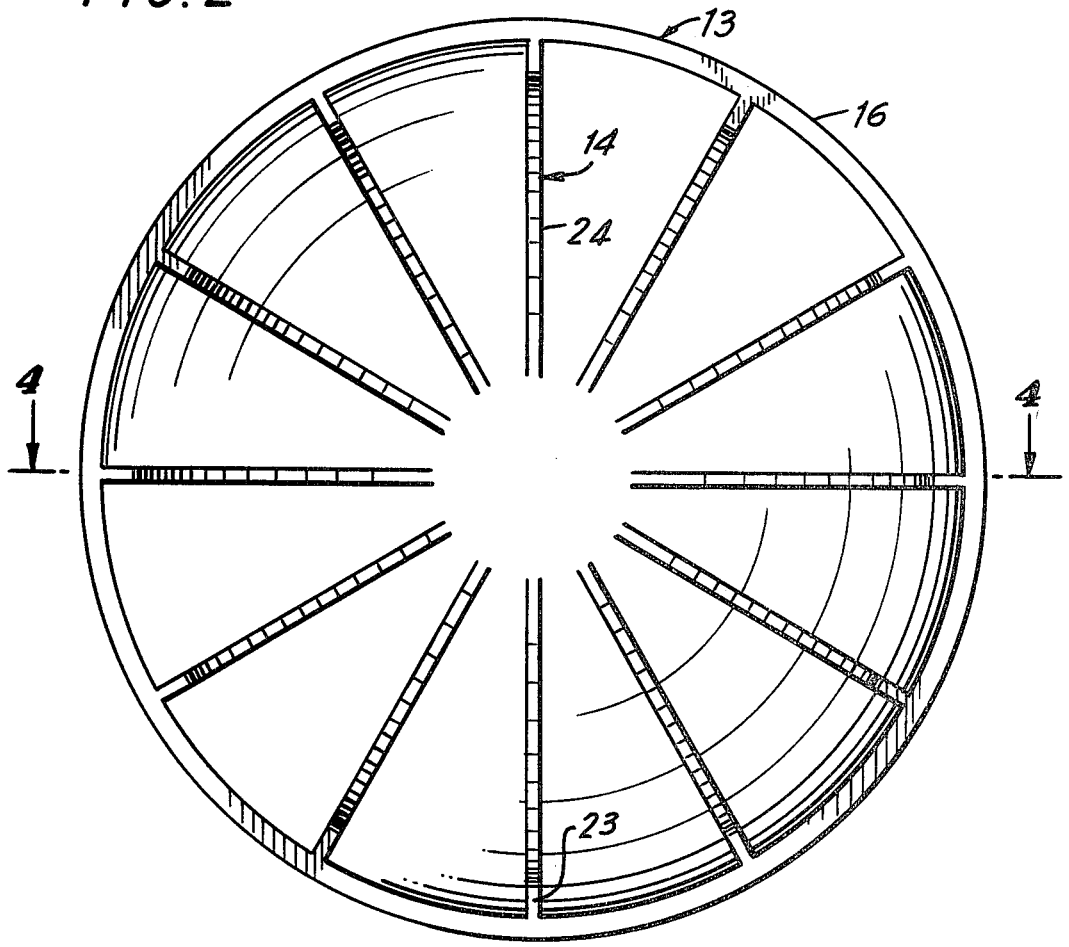
FIG. 2 is a bottom view of an insert of this invention.
Figure 4:
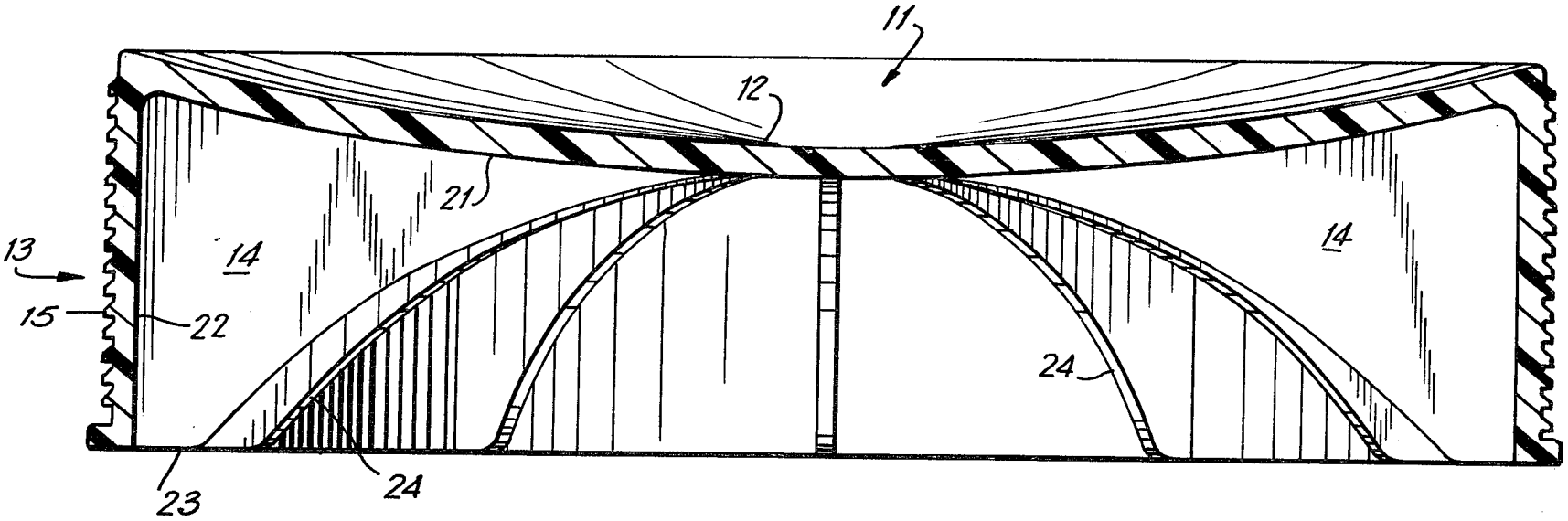
FIG. 4 is a view taken along lines 4—4 of FIG. 2 of an insert of this invention.

The insert comprises a top concave spherical face 11 (FIG. 4) having a circumferential edge 12; an inverted annular flange 13 depending from edge 12; and a plurality of support members 14 (FIG. 2) underlying annular flange 13 and all but the central portion of the face. This relationship is best shown in FIGS. 2 and 4.

While the size and concavity of the face is dependent on the particular size container and pressurized fluid contained therein, preferably the sphere defining the surface of the face has a radius substantially larger than the diameter of the face itself.

Figure 3:
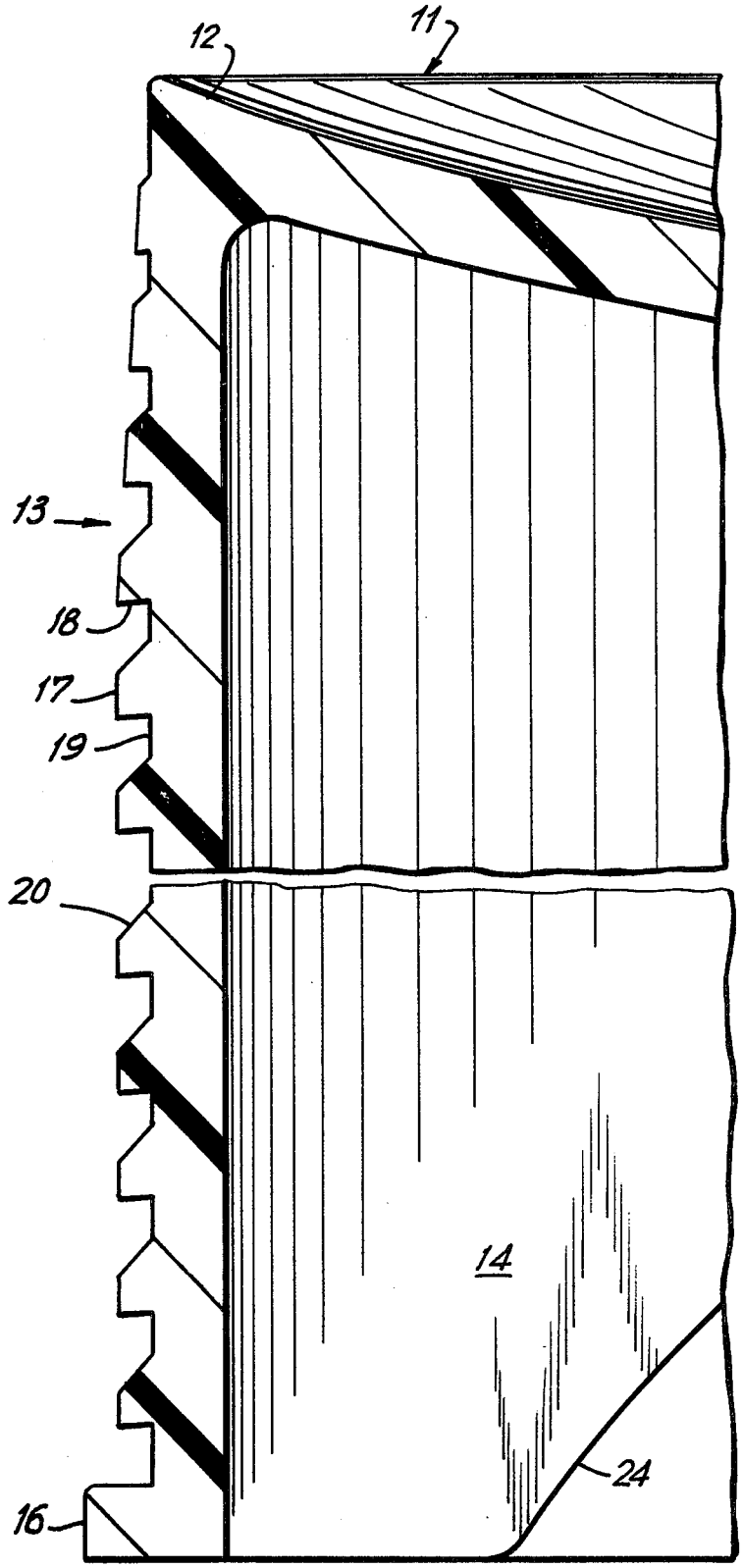
FIG. 3 is a sectional edge view of an insert of this invention taken along lines 3—3 of FIG. 1. It displays the buttress-type threads of this invention.

The outer surface of flange 13 is preferably threaded by rolled buttress-type threads 15. These are best illustrated in FIG. 3. Of course other well known threads are included within this invention, buttress threads being preferred as they resist loosening. The threads begin adjacent circumferential edge 12 and end adjacent the bottom lip 16 of the flange. The thread track is defined by outer edge 17, transverse edge 18, inner edge 19, and angular edge 20. The dimensions and angular relationship of these edges and the pitch of the thread depend primarily on the size of the particular closure insert being employed and the expected conditions of packaging and use. However, such selection is not part of this invention and can well be effected by those skilled in the art.

Moreover, as normal in threaded applications, the preferred thread of this invention features a tapered lead-in. This incremental increase of the thread means, particularly in aid of threading a non-threaded surface, is illustrated, for example, in the first few thread sections adjacent edge 12 of FIG. 3.

Underlying both inverted annular flange 13 and a major portion of the concave face are a plurality of support members 14. These are best shown in FIG. 2. These members are preferably integrally formed with the face and flange. Referring to FIG. 4, their relationship to these portions of the insert is depicted. The members are formed on the underside 21 of the concave face and inner surface 22 of the annular flange. They preferably include horizontal foot portions 23 extending inward from the base of the flange 13. Their free edges 24 form, in conjunction with the other members and center portion of the underside of the concave face, an arch whose base is the horizontal feet. This arch preferably has a diameter less than that of the concave face. While the arch may be rectangular, triangular or spherical, depending on the shape of free edge 24, most preferably the arch is spherical. Such arch form is depicted in FIG. 4.

It is believed that through the interaction of the concave face and underlying arch and their related support members the downward force of the pressurized fluid on the container base is substantially redirected so as to improve the seal between the threads and the container side walls. Hence, the threaded seal actually becomes stronger as the pressure within the container increases. This attribute advantageously avoids that end closure blow-out often limiting the utility of prior art spiral wound containers for packaging fluids under pressure.

Figure 5:
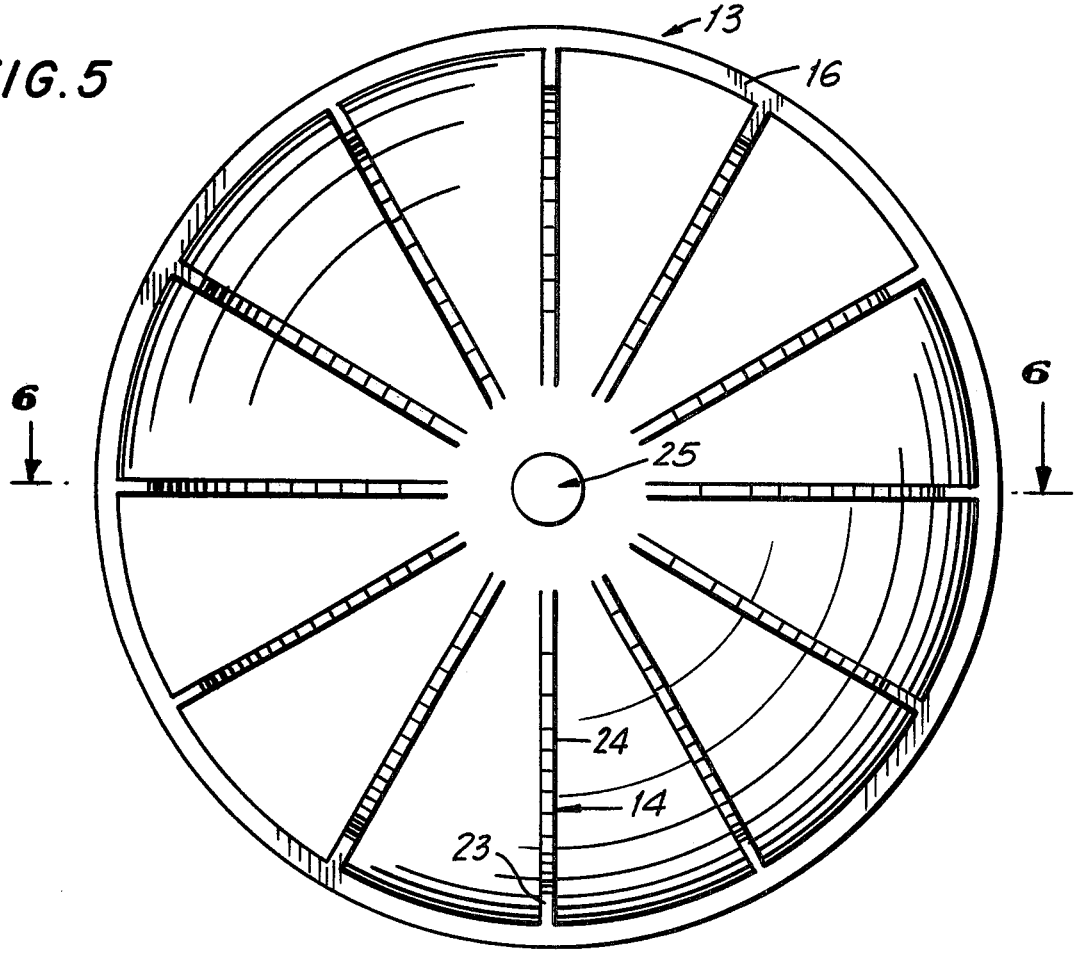
FIG. 5 is a top view of another embodiment of the closure of this invention wherein a valve means is axially positioned in the insert.

Referring to FIG. 5, another embodiment of the closure of this invention is depicted. Here, the insert has been modified to permit container filling subsequent to end closure and later dispensing of the fluid contents for consumption. In this embodiment, the insert includes a sealable filling and dispensing means 25. Although these functions may be provided by separate such means, they are preferably unitary in construction. And, most preferably the filling aperture is sealed after container charging by the insertion of a dispensing valve means therein. Any convenient filling means and valve means may be employed. Those skilled in the art will recognize the selection of such means from those described in the art. More preferably, the valve means are those described in co-filed U.S. patent application, "Tamper-proof Shipping Valve" owned by the common assignee.

Figure 6:
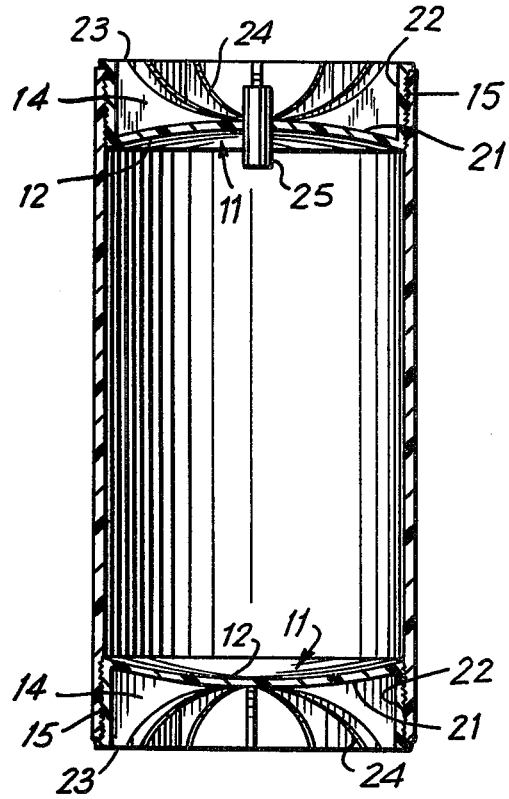
FIG. 6 is a sectional side view of a container closed in accordance with this invention, the top closure being the embodiment depicted in FIG. 5 and taken along lines 6—6 thereof and the bottom closure being the embodiment depicted in FIG. 2 and taken along lines 4—4 thereof.

Under usual packaging conditions the end closures of a completed spiral wound container comprise one of the standard inserts and one of the modified versions. Such an arrangement is depicted in FIG. 6. This combination allows a pressurized fluid to be economically and effectively packaged in a spiral wound container. Yet, the resultant container displays ready access for fluid dispensing and use.

As an aid to the fuller understanding of the insert and closure method of this invention, an insert for an 8 inch diameter spiral wound tube is described. The concave spherical face of this particular insert has a diameter of 8 inches and the curvature of a sphere of a radius of 16.25 inches. The angular flange extends 2.25 inches below the edge of the spherical face. It includes a tapered thread lead in of 3° and a base lip of 0.125 inches. The buttress-type thread of the flange comprises an outer edge of 0.069 inches, a transverse edge 5° above horizontal and 0.062 inches in length, an inner edge of 0.074 inches and an angular edge 45° below horizontal and connecting the inner edge with the outer edge. The thread has a pitch of 0.20 inches. The underlying support legs number twelve and are equally spaced at 30° intervals. They define a spherical arch of diameter 7.0 inches and the curvature of a sphere of radius 4.58 inches. At the center point the arch has a height of 1.56 inches.

While we have hereinbefore presented a number of embodiments of our invention, it is apparent that our basic construction can be altered to provide other embodiments which utilize our invention. Thus, it will be appreciated that the scope of our invention is to be defined by the claims appended hereto rather than the specific embodiments which have been hereinbefore presented by way of example.

I claim:

1. A container closure comprising a concave spherical face; an inverted annular flange depending therefrom, the outer surface of said flange being threaded; and a plurality of radial support members underlying said flange and a major portion of said face, said major portion excluding the central area of said face, said radial support members including horizontal feet portions extending inwardly from the base of said flange to the interior of said closure, and said radial support members and the unsupported central portion of the concave face defining an arch of lesser diameter than that of the concave spherical face, said arch being of a size and shape sufficient to transform a major portion of forces vertical to the concave face into force components more horizontal to said face to strengthen the seal between the closure and the walls of the container.

2. The container of claim 1 wherein the diameter of said spherical face is substantially less than the radius of the sphere defining the surface of said face.

3. The container closure of claim 1 wherein said flange is threaded with buttress-type threads.

4. The container closure of claim 1 wherein said arch is selected from the group of rectangular, triangular and spherical arches.

5. The container closure of claim 1 including a sealable filling and dispensing means extending through a portion of said central area of said face.

6. The container closure of claim 5 wherein said filling and dispensing means comprises a filling orifice sealable subsequent to container filling by a valve means insertable therein.

7. A method for packaging a fluid under pressure in a disposable open ended tube-like container comprising:

a. turning a first end closure comprising a concave spherical face; an inverted annular flange depending therefrom, the outer surface of said flange being threaded; and a plurality of radial support members underlying said flange and a major portion of said face, said support members not underlying the central portions of said concave face and including horizontal feet portions extending inwardly from the base of said flange to the interior of said closure, and said members and said unsupported central portion of said face defining an arch of lesser diameter than that of said concave spherical face said arch being of a size and shape sufficient to transform a major portion of forces vertical to the concave face into force components more horizontal to said face to strengthen the seal between the closure and the walls of the container, into one end of said container;

b. turning a second end closure comprising a concave spherical face; an inverted annular flange depending therefrom, the outer surface of said flange being threaded; a plurality of radial support members underlying said flange and a major portion of said face, said support members not underlying the central portion of said face and including horizontal feet portions extending inwardly from the base of said flange to the interior of said closure, and said members and said unsupported central portion of said face defining an arch of lesser diameter than that of said concave spherical face, said arch being of a size and shape sufficient to transform a major portion of forces vertical to the concave face into force components more horizontal to said face to strengthen the seal between the closure and the walls of the container; and a sealable filling and dispensing means extending through a portion of said unsupported central portion of said concave face, into the opposite end of said container;

c. filling a major portion of said container with said fluid under pressure through said filling means; and d. sealing said filling means.

8. The method of claim 7 wherein said sealing of said filling means comprises the inserting of a dispensing valve therein.

9. In a sealed disposable paperboard container for packaging a fluid under pressure, the improvement comprising:

a. a first end closure means comprising a concave spherical face; an inverted annular flange depending therefrom, the outer surface of said flange being threaded; and a plurality of radial support members underlying said flange and a major portion of said face, said support members not underlying the central portions of said concave face and including horizontal feet portions extending inwardly from the base of said flange to the interior of said closure, and said members and said unsupported central portion of said face defining an arch of lesser diameter than that of said concave spherical face, said arch being of a size and shape sufficient to transform a major portion of forces vertical to the concave face into force components more horizontal to said face to strengthen the seal between the closure and the walls of the container; and b. a second end closure means comprising a concave spherical face; an inverted annular flange depending therefrom, the outer surface of said flange being threaded; a plurality of radial support members underlying said flange and a major portion of said face, said support members not underlying the central portion of said face and including horizontal feet portions extending inwardly from the base of said flange to the interior of said closure, and said members and said unsupported central portion of said face defining an arch of lesser diameter than that of said concave spherical face, said arch being of a size and shape sufficient to transform a major portion of forces vertical to the concave face into force components more horizontal to said face to strengthen the seal between the closure and the walls of the container; and a sealable filling and dispensing means extending through a portion of said unsupported central portion of said face.

* * * * *